US006872423B2

(12) United States Patent
Brown et al.

(10) Patent No.: US 6,872,423 B2
(45) Date of Patent: Mar. 29, 2005

(54) HEATING OF GOLF BALLS PRIOR TO PAINTING

(75) Inventors: Stanley W. Brown, North Attleboro, MA (US); David W. Sauerbrey, Marion, MA (US); Robert N. Lammi, Norton, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/793,974

(22) Filed: Mar. 5, 2004

(65) Prior Publication Data

US 2004/0170763 A1 Sep. 2, 2004

Related U.S. Application Data

(62) Division of application No. 10/209,653, filed on Jul. 30, 2002, now Pat. No. 6,755,912.

(51) Int. Cl.[7] ..... B05D 3/02

(52) U.S. Cl. ..... 427/314; 427/421.1; 118/500; 206/315.9; 206/562; 211/14; 269/900

(58) Field of Search ..... 427/421, 314, 427/315

(56) References Cited

U.S. PATENT DOCUMENTS 3,683,155 A * 8/1972 Loofbourow et al. ..... 219/521
4,704,298 A 11/1987 Herman et al. ..... 427/34
5,130,173 A * 7/1992 Barten et al. ..... 427/314
5,725,891 A 3/1998 Reid, Jr. ..... 425/407
6,200,650 B1 3/2001 Emch ..... 427/542
6,245,386 B1 6/2001 Felker et al. ..... 427/258
6,319,563 B1 * 11/2001 Skrabski et al. ..... 427/511
2001/0031672 A1 * 10/2001 Cao et al. ..... 473/378
2002/0016226 A1 2/2002 Jin et al. ..... 473/378
2004/0017027 A1 * 1/2004 Vora et al. ..... 264/491

* cited by examiner

*Primary Examiner*—Shrive P. Beck
*Assistant Examiner*—David Turocy
(74) *Attorney, Agent, or Firm*—D. Michael Burns

(57) ABSTRACT

A method for preheating golf ball covers prior to painting. The process comprises forming a golf ball with a cover, then heating the cover from about 90° F. to about 150° F. for 1 to 3 hours in a heated enclosure prior to applying a coat of primer or paint to the ball. This is done to accelerate the evaporation of paint solvents, immediately after the paint is applied. The painted balls are subsequently dried in a heated enclosure at about 105° F. to 108° F. All additional coats of primer or paint are applied in a similar fashion, wherein the balls are painted while still in the heated state and not cooled down.

5 Claims, 3 Drawing Sheets

HEATING OF GOLF BALLS PRIOR TO PAINTING

CROSS REFERENCE TO RELATED APPLICATIONS

This application is a divisional of application Ser. No. 10/209,653, filed Jul. 30, 2002, now U.S. Pat. No. 6,755,912, the disclosure of which is hereby incorporated by reference in its entirety.

FIELD OF THE INVENTION

The invention relates to a method of manufacturing golf balls. More specifically, the present invention relates to a method of heating golf balls prior to painting.

DESCRIPTION OF THE RELATED ART

Conventional golf balls can be classified as one-piece, two-piece, and three-piece balls. One-piece balls are molded from a homogeneous mass of material with a dimple pattern molded therein. Two-piece balls are made by molding a cover about a solid core. Three-piece are typically, but not always wound balls which are made by molding a cover about a wound core. The core of a two-piece ball is typically formed of rubber and can be solid, semi-solid or have a liquid center. A wound core is prepared by winding a lengthy thread of elastic material about-the rubber core described above. The wound core is then surrounded with a cover material. The more recent trend in the golf ball art is towards the development of multi-component golf balls such as balls having two or more cover layers, two or more core layers or both multiple core and multiple cover layers.

Golf ball covers are presently formed from a variety of materials, such as balata, SURLYN®, IOTEK®, and polyurethane, depending upon the performance characteristics desired for the golf ball.

All golf balls, regardless of type, have an outer surface that contains a dimple pattern. As used herein, "dimples" refer the topical relief of the outer surface of the ball, typically depressions or indentations formed into to provide desired aerodynamic effects. However, the dimple pattern may comprise of any form of topical relief on the outer surface of the golf ball formed to provide a desired aerodynamic effect to the ball, including formations such as protrusions from the outer surface.

Further to the above, golf balls are provided in a variety of colors. Conventionally they are white, but they may be manufactured in essentially any desired color, including yellow, orange and pink. The color is imparted to the ball either by applying layers of paint to the outer surface of the cover or by incorporating a pigment directly into the cover composition. Typically, in a painted ball, at least one primer layer is applied, followed by a second, finishing coat layer. After a ball has been provided with a color, identifying indicia such as a trademark, logo, identification number, model name or number and the like are hot stamped or pad printed onto the ball.

Golf balls must be capable of withstanding a variety of weather conditions such as strong sunlight, extreme temperature ranges, and immersion in water, preferably for an extended period. Further, the surface of a golf ball is flexed due to the impact every time it is struck with a club and consequently these surfaces must be able to withstand such repeated stresses. Moreover, especially with the recreational player, golf balls are susceptible to striking any of a number of hard, abrasive surfaces such as concrete, asphalt, brick, stone, etc. as a result of errant shots. It is therefore desirable for golf ball manufacturers that their golf balls be resistant to delamination or chipping of the paint layers, as such defects impact negatively upon the public perception of the quality of the golf ball. Likewise, golf ball manufacturers also seek to prevent obliteration of all or part of their trademarks, logos or other identifying indicia which identifies the brand of the ball to the playing public. Protective coatings are therefore applied to the surface of the golf ball cover. A clear primer coat and top coat layer are commonly applied to the cover to provide a high gloss and an overall enhanced appearance to the ball. In such coated balls, the various identifying indicia may be applied either to the cover, the primer coat or the topcoat.

Protective and decorative coating materials, as well as methods of applying such materials to the surface of a golf ball cover are well known in the golf ball art. Generally, such coating materials comprise urethanes, urethane hybrids, polyesters and acrylics. If desired, more than one coating layer can be used. Typical two pack polyurethane coatings include separate packages of polyol and diisocyanate. Conventionally, a primer layer such as a solvent-based or a water-based polymer may be applied to promote adhesion or to smooth surface roughness before the finish coat(s) are deposited on the golf ball. In general, a cured polyurethane top coat is most widely used as a protective coating material.

One problem encountered during golf ball coating is that each coat typically needs to be applied to the golf ball surface in a separate operation after the final molding of the golf ball cover about the core. Each of these steps is time consuming as once each coating is applied to the ball surface, there is a need to allow that coat to cure for a period of time before the next coat is applied. Also, as each of the often successive coats are applied to the golf ball, the definition of the curves on the molded golf ball are smoothed and lose their sharpness due to build-up of the coating composition on the ball's outer surface, which also increases the outer diameter of the ball.

Typical paints used to coat golf balls, including urethane golf balls, comprise two component polyurethane coatings, which have good impact resistance. One of the problems associated with conventional two component polyurethane coatings is that they dry slowly.

Because of the slow drying nature of conventional polyurethane coatings, the golf ball painting process requires many steps. In the conventional process for clear-coating a golf ball, the surface-prepared balls are first mechanically loaded onto a stamping machine that prints a logo or stamp on the balls. The balls are then continuously loaded onto spindles that carry the balls and travel along with a moving chain to pass by spray guns that apply a clear polyurethane top-coating to the balls. The chain then moves wet, painted balls through a heated oven to pre-cure the coating. When they reach the end of the oven, the painted balls are usually still not dry, and have to be unloaded from spindles on the moving chain onto holding trays. The holding trays with the balls are then placed into another heated oven to bake at 105° F. to 108° F. for as long as 16 hours or in some cases even longer in order to completely cure the coating before further processing or handling. Due to the slow-drying nature of a conventional clear coat polyurethane system, all these steps, especially the 16 hour baking process, are usually necessary.

The conventional painting process has many drawbacks. First, loading wet balls from spindles on a moving chain onto holding trays, even if done by robotic handling, often results in damage or destruction of the surface of the balls.

Secondly, there is a substantial labor cost to unload cured balls from the trays into collecting hoppers for further processing. Thirdly, oven baking for 16 hours is time-consuming and consumes a substantial amount of energy. The ovens are large and require a large amount of floor space, which is also costly. The number of steps reduces productivity substantially.

In addition, an inevitable, substantial problem is that unloading wet balls off spindles onto loading trays often leaves balls with scratches or pin marks because the balls with wet paint have to be touched by another device. These scratches or marks are major causes of quality control rejection for surface defects.

For the foregoing reasons, there is a need for an improved process that will reduce the time for drying of the paint during the necessary steps. Further, there exists a need for an apparatus that will allow for a minimum of contact damage to the ball as it is supported on the apparatus.

SUMMARY OF THE INVENTION

One embodiment of the present invention provides for a process for heating a golf ball cover from about 90° F. to about 150° F. for 1 to 3 hours in a heated enclosure prior to applying a coat of primer or paint to the ball. This is done to accelerate the evaporation of paint solvents, immediately after the paint is applied. The painted balls are subsequently dried in a heated enclosure at about 105° F. to 108° F. All additional coats of primer or paint are applied in a similar fashion, wherein the balls are painted while still in the heated state and not cooled down.

An object of the invention is to reduce the flow of paint and the resulting blemish formed during the drying process. By reducing the contact area between the freshly painted ball and the drying tray holding them, the blemish is further minimized. This is accomplished by supporting the ball on a plurality of finely pointed conical pins during the drying process.

Another object of the invention is to provide process that employs a ventilated holding tray which in addition to holding the golf balls with a minimum of contact between ball and tray, the tray will allow for a thorough flow of heat about the ball for a quick and uniform heating of the ball.

Still another object is for a process that reduces blemishes to the golf ball, by suspending the freshly painted golf ball on conical pins set at right angles to the ball, thereby reducing physical contact between the tray and the freshly painted golf ball.

A further object of the invention is to provide a process that employs trays with replaceable ball supports or inserts. The inserts will generally be made from injection molded plastic and will be friction-fitted to the tray, and if damaged can be easily and inexpensively replaced. The pins being, recessed into the inserts, provides a considerable margin of safety when the trays are manually handled.

DESCRIPTION OF THE PREFERRED EMBODIMENTS

A golf ball may comprise a one-piece construction or it may include several layers including a core and an outer cover surrounding the core. The outer surface of the cover may include one or more pigmented or non-pigmented protective coatings. The outer cover of the golf ball is preferably made of any number of thermoplastic or thermosetting materials, including thermoplastic resins such as ionomeric, polyester, polyethrester resins; thermoplastic or thermoset polyurethanes; natural or synthetic rubbers such as balata (natural or synthetic) or polybutadiene; or some combination of the above. This list, however, is merely illustrative and shall not limit the types of materials suitable for use in the golf balls and methods of the present invention.

The present invention provides for a method for heating a golf ball cover prior to applying a coat of primer or paint. This is in contrast to conventional methods of applying heat after applying the paint. It is desirable to accelerate the drying of golf balls to minimize blemishes which a wet surface can pick-up, and to improve the smoothness of the golf ball surface.

The method of the present invention is to turn the golf ball into a heat source, by pre-heating the golf ball prior to painting it, whereby the process of drying applied coats of paint will inherently begin immediately upon the application of the paint. This will significantly reduce the amount of time required in a drying room, and the acceleration of the evaporation of paint solvents will greatly reduce blemishes caused upon the balls being handled, whether manually or by automation.

Figure 1:
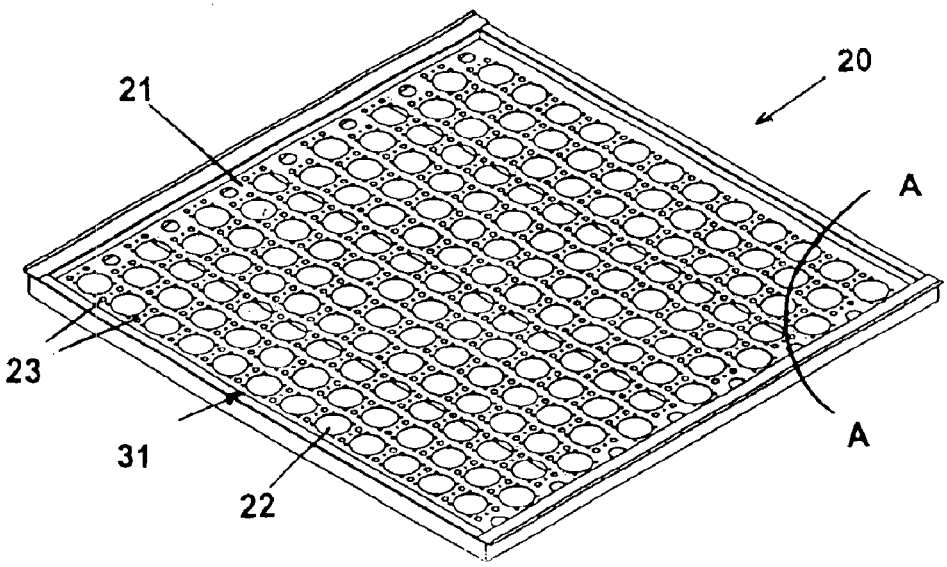
FIG. 1 is a pictorial view of the holding tray showing the hole pattern.
Figure 2:
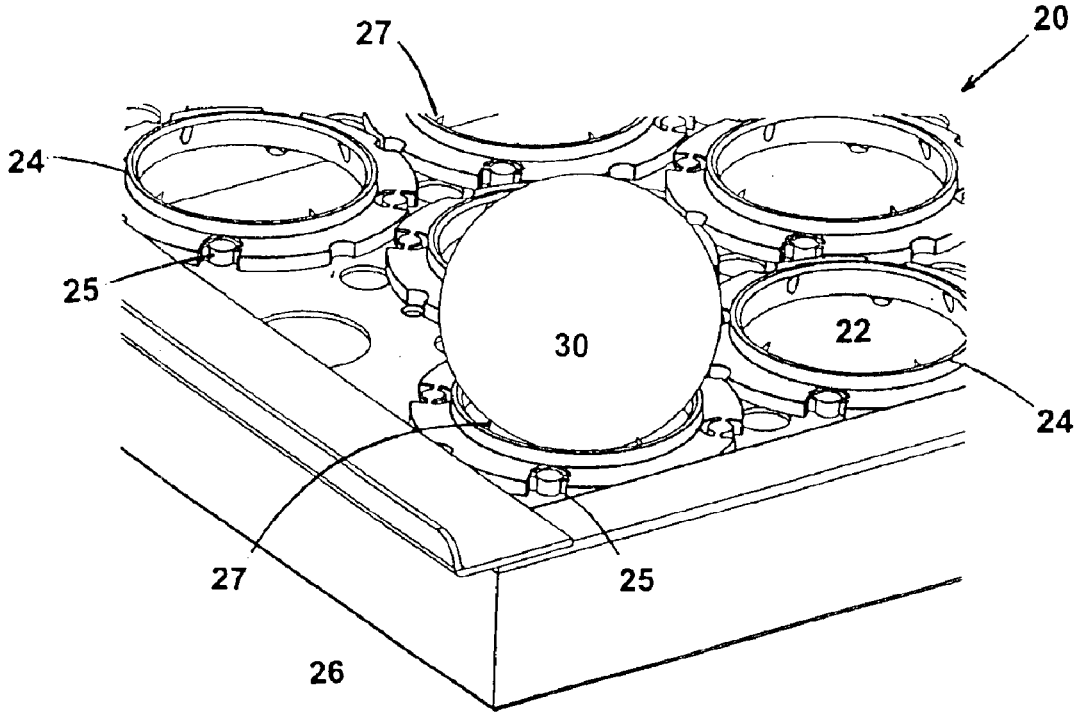
FIG. 2 is a pictorial view taken along line A—A of FIG. 1, wherein a golf ball is suspended upon an insert.
Figure 3:
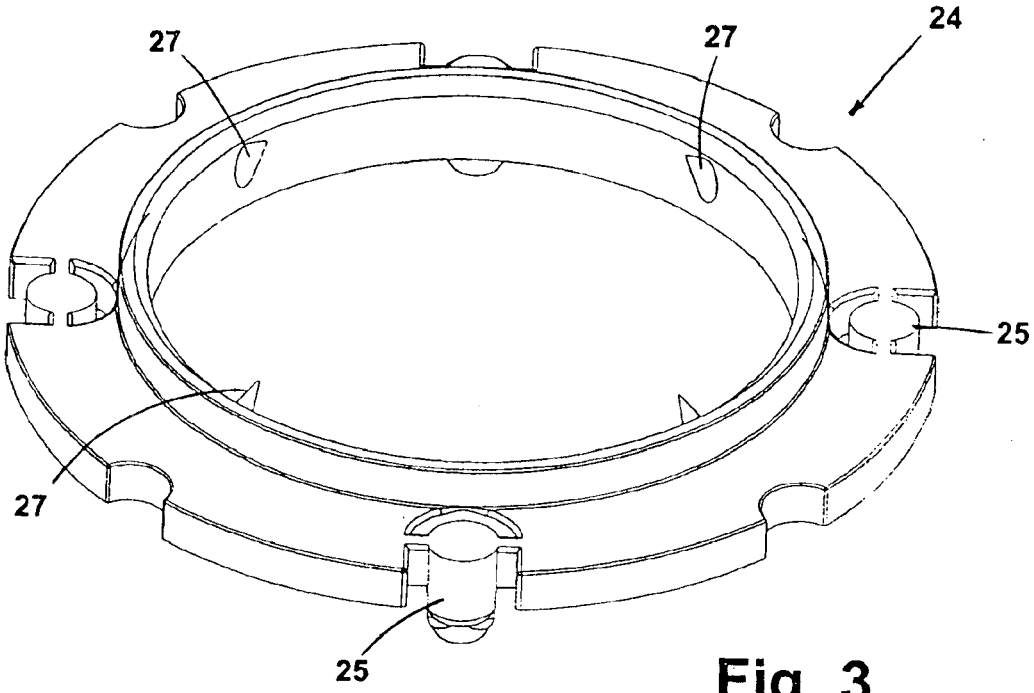
FIG. 3 is a top pictorial view of the insert.
Figure 4:
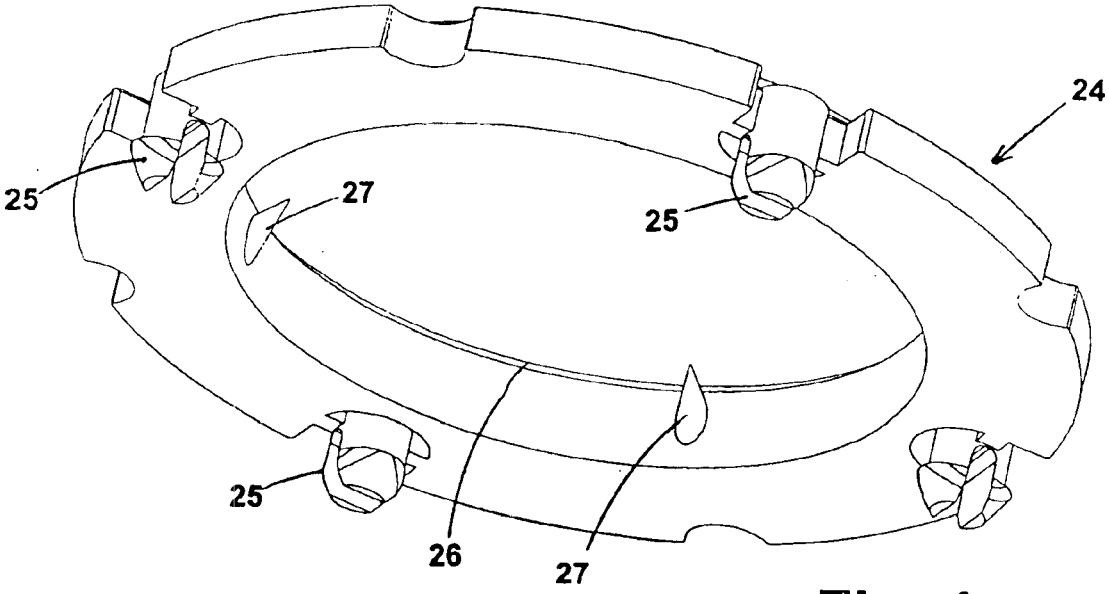
FIG. 4 is a bottom pictorial view of the insert.
Figure 5:
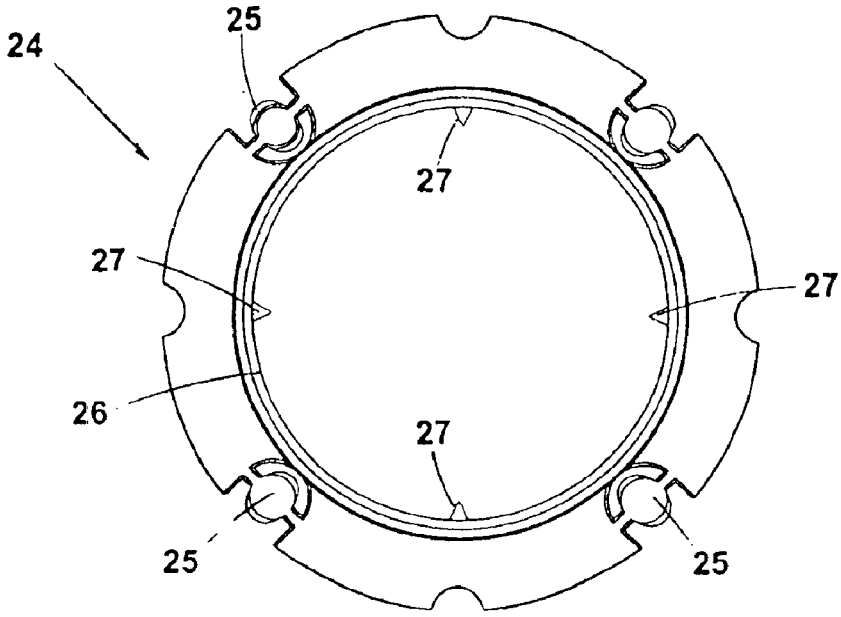
FIG. 5 is a top view of the insert.
Figure 6:
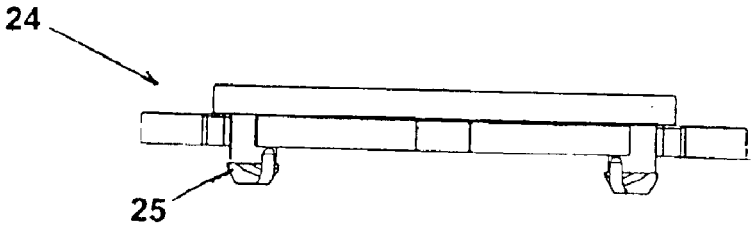
FIG. 6 is a front elevational view of the insert of FIG. 5.
Figure 7:
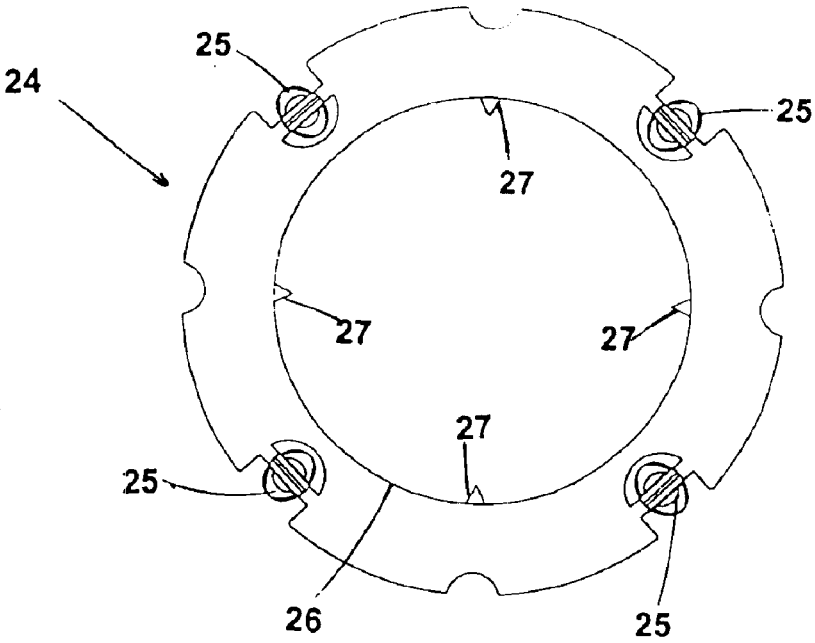
FIG. 7 is a bottom view of the insert.

The present method would place the golf balls in ventilated trays 20 shown in FIGS. 1 and 2. The trays 20 would have in their substrate surface 21, a plurality of ball station positions 31, each comprised of a large opening 22 and four smaller openings 23. FIG. 2 is taken along A—A of FIG. 1 and depicts a golf ball suspended, with minimal contact, upon a ball support insert 24.

Each insert 24, as illustrated in FIGS. 3–7, is comprised of a plurality of push-in-connectors 25, that are shown to be four in number in the figures, which are pushed through small openings 23 of substrate 21 to releasably attach in a friction-fit to the tray 20. Each insert 24 has an inner perimeter 26 wherein a plurality of finely pointed and recessed conical pins 27 are integrally disposed such that they are at substantially right angles with the golf ball 30. The pins 27 support the ball 30, such that a minimal contact area between golf ball 30 and tray 20 is achieved. The ball 30 is virtually suspended in air, which allows for a maximum of exposure of ball to the heating and drying processes. Also, by reducing the contact area, blemishes are minimized.

The inserts 24 will generally be made from low friction materials such as lightweight coated metal or preferably injection molded plastic and will be friction-fitted to the tray 20, and if damaged can be easily and inexpensively replaced. The pins 27, being recessed into the inserts 24, provide a considerable margin of safety when the tray is manually handled. The use of injection molded plastic precludes the need for teflon coating. The tray 20 including substrate surface 21 are preferably made of metal and more preferably made of stainless steel. It is conceived that the substrate surface 21 could also be plastic.

In the past, the trays, for handling and holding the golf balls as they dried, did not include replaceable inserts. Thus, whenever a tray was damaged, it very easily caused the golf ball to mar or blemish. To correct this problem, the entire tray had to be abandoned. The present invention, by utilizing replaceable and disposable inserts 24 (the cost for the plastic inserts 24 not a significant factor) makes repairing the tray 20 a matter of nothing more than snapping in and out replaceable inserts 24. And as discussed above, the pins allow for a quicker and more uniform heating of the ball 30, and a quicker drying time with less blemishes.

The method of the invention would have a plurality of balls 30, each having an outer cover, and each suspended upon an insert 24 in the tray 20. They then would be heated in a controlled heating enclosure for one to three hours until the ball surface achieves a temperature of about 90° F. to about 150° F. prior to having a coat of paint applied. Then the balls 30 are placed on spindles, not shown but which are well known to those in the industry, for painting. The balls 30 are then manually, or by automation means, moved back to trays 20 for placement in a heated drying room at about 105° F. to about 108° F. When subsequent coatings are applied they are applied while the ball 30 is still hot and has not cooled down, While it is apparent that the embodiments of the invention herein disclosed fulfills the objectives stated above, it will be appreciated that numerous modifications and other embodiments may be devised by those skilled in the art. Therefore, it will be appreciated that the appended claims are intended to cover all such modifications and embodiments which come within the spirit and scope of the present invention.

We claim as our invention the following:

1. A method of manufacturing a golf ball comprising:

forming a plurality of golf balls, each having a cover;

placing the golf balls in a ventilated tray having a plurality of ball station positions, each station having a replaceable ball support insert friction-fitted therein with a plurality of recessed conical pins mounted on the inner perimeter for suspending the golf ball;

heating the golf ball covers to a temperature greater than about 100° F.; and applying at least one coat of paint to the heated covers.

2. The method according to claim 1, wherein the heating of the golf ball covers is to a temperature within the range of about 100° F. to about 150° F.

3. The method according to claim 1, wherein the cover is select from the group consisting of a thermoset polyurethane, a thermoplastic polyurethane, an ionomer thermoplastic elastomer, and an ionomeric thermoplastic elastomer.

4. The method according to claim 1, wherein heating of the golf ball cover is for about one hour to about three hours in a controlled heating enclosure.

5. The method according to claim 1, wherein after applying the coat of paint to the golf ball cover, it is then dried in a heated drying room at about 105° F. to about 108° F.

* * * * *